US008925428B2

(12) United States Patent
Wang

(10) Patent No.: US 8,925,428 B2
(45) Date of Patent: Jan. 6, 2015

(54) RETURNING DEVICE OF A WRENCH TOOL

(76) Inventor: Yeo-Ming Wang, Taipei (TW)

( * ) Notice: Subject to any disclaimer, the term of this patent is extended or adjusted under 35 U.S.C. 154(b) by 261 days.

(21) Appl. No.: 13/410,819

(22) Filed: Mar. 2, 2012

(65) Prior Publication Data

US 2013/0228052 A1 Sep. 5, 2013

(51) Int. Cl.
*B25B 13/12* (2006.01)
*B25B 13/00* (2006.01)

(52) U.S. Cl.
USPC ..... 81/179; 81/186

(58) Field of Classification Search
CPC ..... B25B 13/12; B25B 13/00; B25B 13/08
USPC ..... 81/179, 57.21
See application file for complete search history.

(56) References Cited

U.S. PATENT DOCUMENTS 2,646,711 A * 7/1953 Yavner ..... 81/179
2,855,814 A * 10/1958 Yavner ..... 81/179
2,879,681 A * 3/1959 Blasdell ..... 81/179
2,937,551 A * 5/1960 Akers ..... 81/179
3,165,015 A * 1/1965 Hinrichs ..... 81/179
6,202,516 B1 * 3/2001 Kim ..... 81/179
6,637,300 B2 * 10/2003 Wu ..... 81/186
6,945,143 B2 * 9/2005 Kim ..... 81/179
7,255,026 B1 * 8/2007 Lee ..... 81/179
7,806,025 B2 * 10/2010 Xinhong ..... 81/179
8,347,764 B2 * 1/2013 Tuan-Mu et al. ..... 81/179
2009/0272236 A1 * 11/2009 Tuan-Mu ..... 81/60
2009/0301271 A1 * 12/2009 Tuan-Mu et al. ..... 81/179

* cited by examiner

*Primary Examiner* — Monica Carter
*Assistant Examiner* — Danny Hong

(57) ABSTRACT

A returning device of a wrench tool contains a body including a tool segment disposed on at least one end portion thereof and having two jaws, an engaging face of at least one of the two jaws including a recessed section in which a receiving groove with a stop rim is formed, the stop rim including a slot fixed on an eccentric position thereof; an auxiliary retainer inserted in the receiving groove and having a retaining portion; a positioning shaft including a front end connected at an eccentric position of a rear end of the auxiliary retainer and including a rear end extending out of the slot and allowing to prevent the auxiliary retainer from disengagement from the receiving groove; a resilient element used to push the auxiliary retainer so that the retaining portion extends out of the recessed section of the at least one of the two jaws.

10 Claims, 15 Drawing Sheets

RETURNING DEVICE OF A WRENCH TOOL

BACKGROUND OF THE INVENTION

1. Field of the Invention

The present invention relates to a returning device of a wrench tool in which an auxiliary retainer is fixed without rotation by using an eccentric positioning of the auxiliary retainer and a positioning shaft so that the auxiliary retainer retain a bolt tool securely.

2. Description of the Prior Art

With reference to FIG. 1, a conventional open end wrench 1 disclosed in TW Pub. No. 1355990 comprises a handle H, the handle H includes an open driving portion 100 having a first jaw 110 with a first engaging face wall 114, a second jaw 120 with a second engaging wall 124, and a chamber 160 between the first jaw 110 and the second jaw 120. The first engaging wall 114 of the first jaw 110 includes a recessed section 112 formed thereon to receive a projection of a workpiece W during idly rotating process of the open end wrench, the second engaging wall 124 of the second jaw 120 includes an inner face 126 extending inward therefrom, and between an extending line of the second engaging wall 124 and the inner face 126 is defined a room 128, the inner face 126 includes an orifice 130 connecting with the room 128 to receive an auxiliary retainer 140 and a spring S, the auxiliary retainer 140 includes an abutting face 143 and a pressing face 144, both of which are fixed on one end of the auxiliary retainer 140, the auxiliary retainer 140 also includes a slot 148 arranged on an external side thereof, and the second jaw 120 includes a limiting element 150 inserted therein and engaged with the slot 148 so as to limit the auxiliary retainer 140 to move between a first unpressed position and a second unpressed position. Referring further to FIG. 2, as operating the open end wrench 1 to rotate the workpiece W, the auxiliary retainer 140 is located at the first unpressed position so that the abutting face 143 retains the workpiece W with the first jaw 110 and rotates the workpiece W. As shown in FIG. 3, in an idle rotating operation, the open end wrench is rotated reversely, and the pressing face 144 of the auxiliary retainer 140 is reacted by a peripheral side WS of the workpiece W so that the auxiliary retainer 140 moves back to a second position of the orifice 130, and then the open end wrench 1 can be rotated idly in an reverse direction. However, as manufacturing the orifice 130 and the auxiliary retainer 140 of the second jaw 120, to work the orifice 130 easily, the second jaw 120 is drilled to form a cylindrical orifice 130, and a column-shaped auxiliary retainer 140 matches with the cylindrical orifice 130 and rotates in the cylindrical orifice 130 randomly, but the abutting face 143 of the auxiliary retainer 140 can not contact the peripheral side WS of the workpiece W completely, so the slot 148 has to be arranged on the external side of the auxiliary retainer, and the limiting element 150 is inserted into the second jaw 120 to further engage with the slot 140 so as to limit the auxiliary retainer 140 to move linearly and to prevent the auxiliary retainer 140 from rotation, thereby positioning the abutting face 143 of the auxiliary retainer 140. To move the auxiliary retainer 140 smoothly, the slot 148 has to keep a suitable distance apart from the limiting element 150, but such a suitable distance will cause the auxiliary retainer 140 rotate slightly in the orifice 130, hence the abutting face 143 of the auxiliary retainer 140 can not retain the peripheral side WS of the workpiece W precisely and can not be positioned securely.

The present invention has arisen to mitigate and/or obviate the afore-described disadvantages.

SUMMARY OF THE INVENTION

The primary object of the present invention is to provide a returning device of a wrench tool in which the auxiliary retainer is capable of moving resiliently to provide an idle rotating and returning function in a reverse direction.

Another object of the present invention is to provide a returning device of a wrench tool in which an auxiliary retainer is fixed without rotation by using an eccentric positioning of the auxiliary retainer and a positioning shaft so that the auxiliary retainer retain a bolt tool securely.

To obtain the above objectives, a returning device of a wrench tool provided by the present invention contains:

a body including a tool segment disposed on at least one end portion thereof, and the tool segment having two jaws, an engaging face of at least one of the two jaws including a recessed section in which a receiving groove is formed, and the receiving groove having a stop rim, the stop rim including a slot fixed on an eccentric position thereof;

an auxiliary retainer inserted in the receiving groove of the body and having a retaining portion defined on a frond end thereof;

a positioning shaft including a front end connected at an eccentric position of a rear end of the auxiliary retainer and including a rear end extending out of the slot of the body and allowing to prevent the auxiliary retainer from disengagement from the receiving groove of the body;

a resilient element used to push the auxiliary retainer so that the retaining portion of the auxiliary retainer elastically extends out of the recessed section of the at least one of the two jaws of the body.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
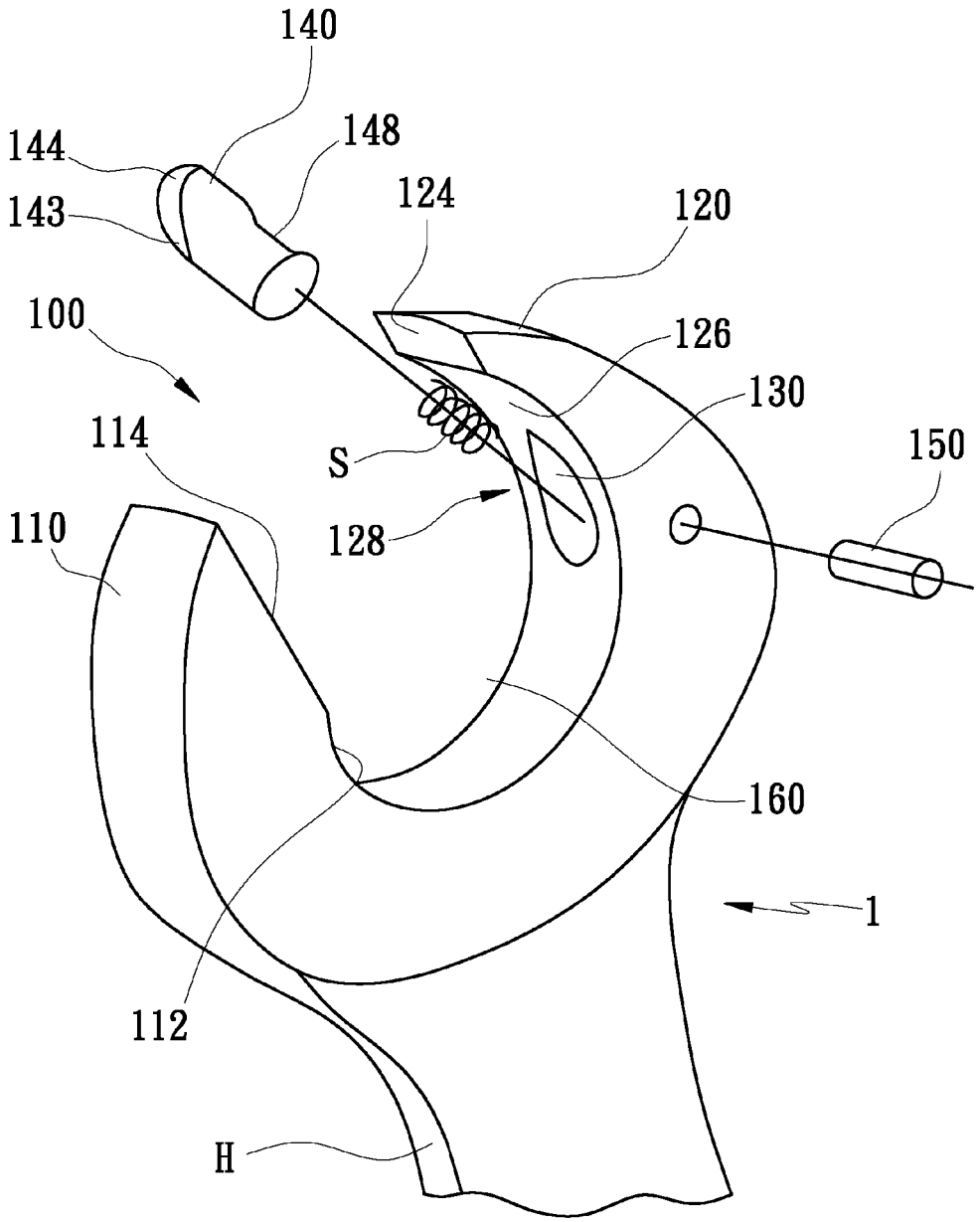
F I G . 1 PRIOR ART
FIG. 1 is a perspective view showing the exploded components of a conventional open end wrench disclosed in TW Pub. No. 1355990.
Figure 2:
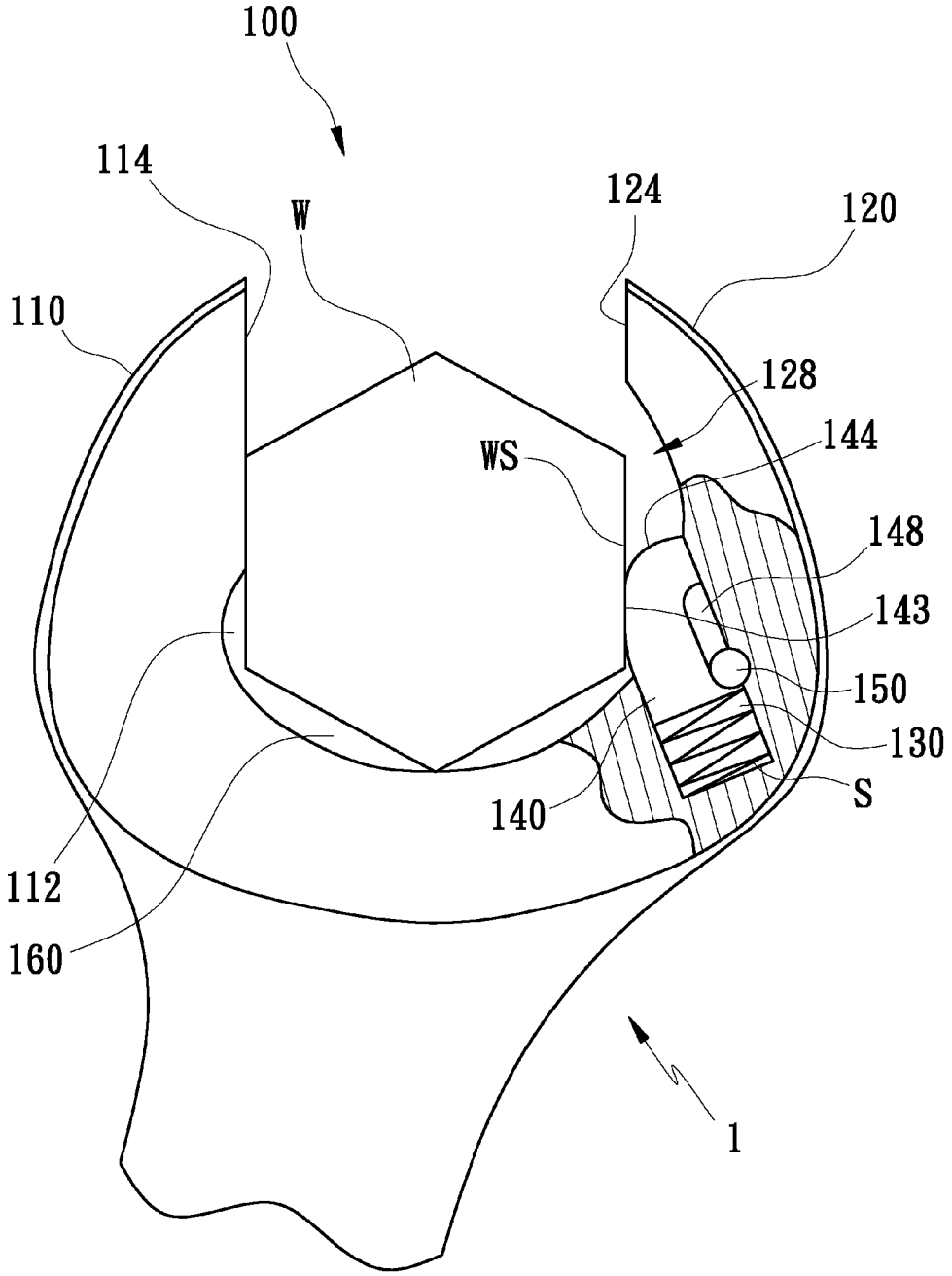
F I G . 2 PRIOR ART
FIG. 2 is a partial cross sectional view showing the operation of a conventional open end wrench disclosed in TW Pub. No. 1355990.
Figure 3:
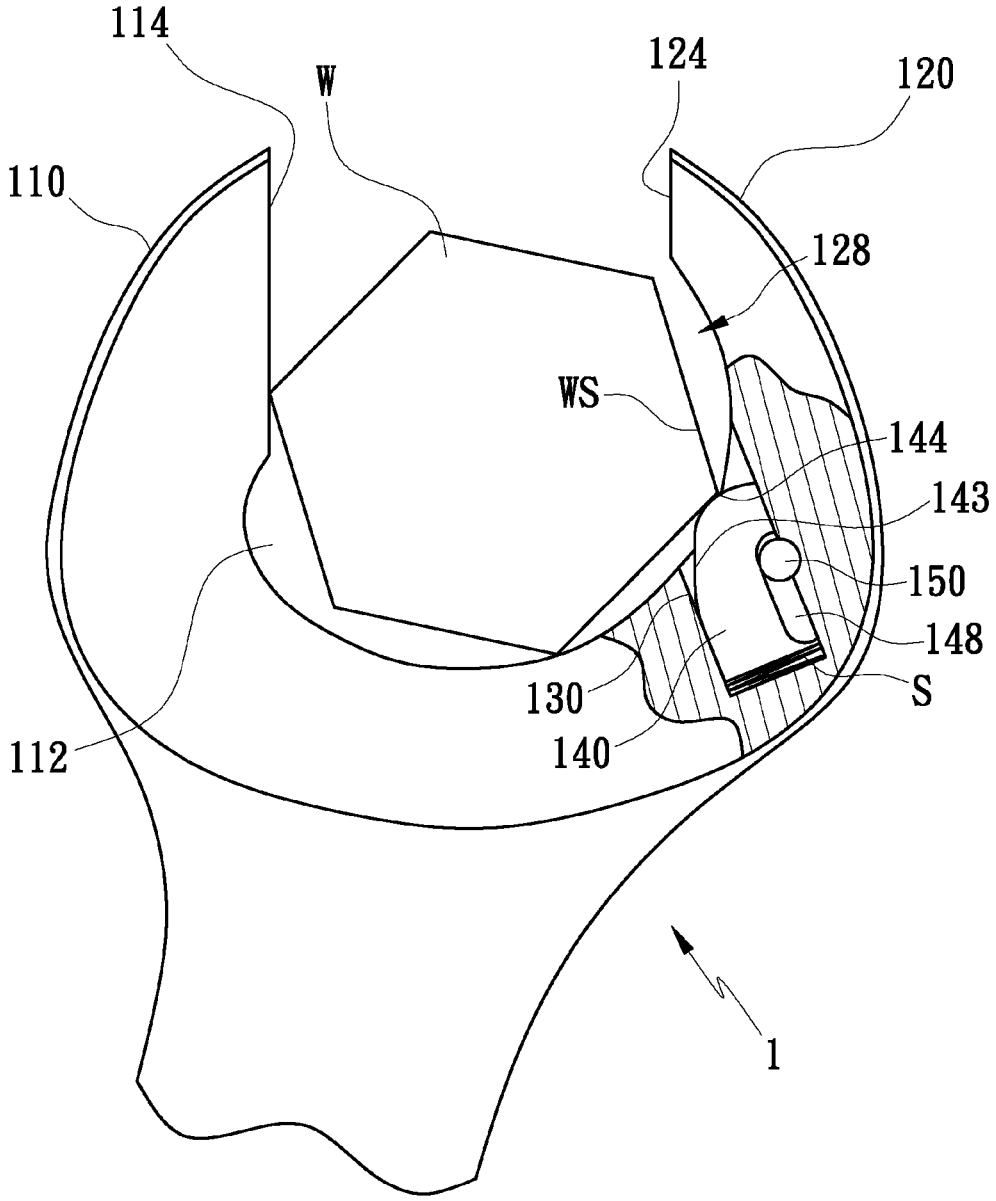
F I G . 3 PRIOR ART
FIG. 3 is another partial cross sectional view showing the operation of a conventional open end wrench disclosed in TW Pub. No. 1355990.
Figure 4:
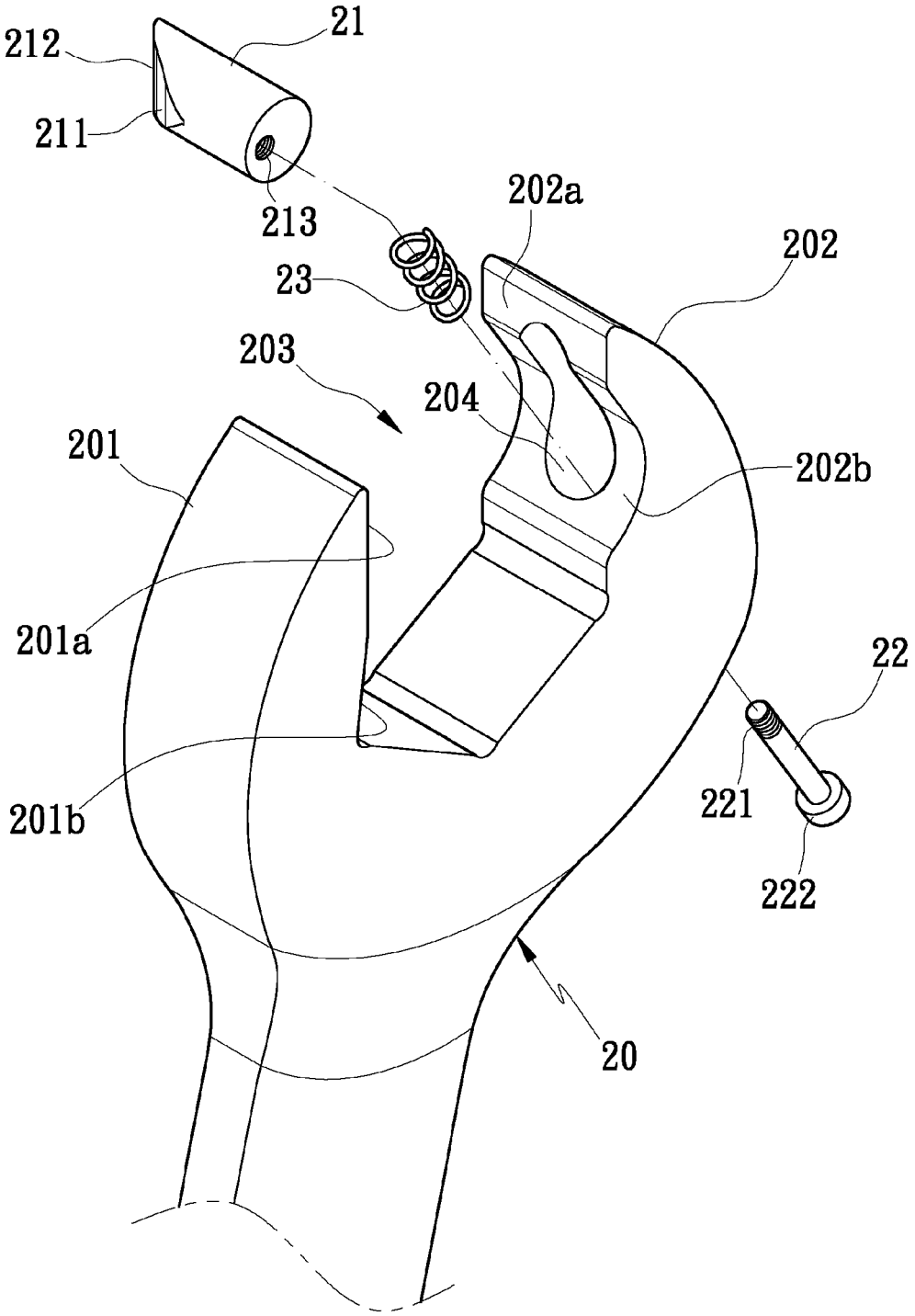
FIG. 4 is a perspective view showing the exploded components of a returning device of a wrench tool according to a first embodiment of the present invention.
Figure 5:
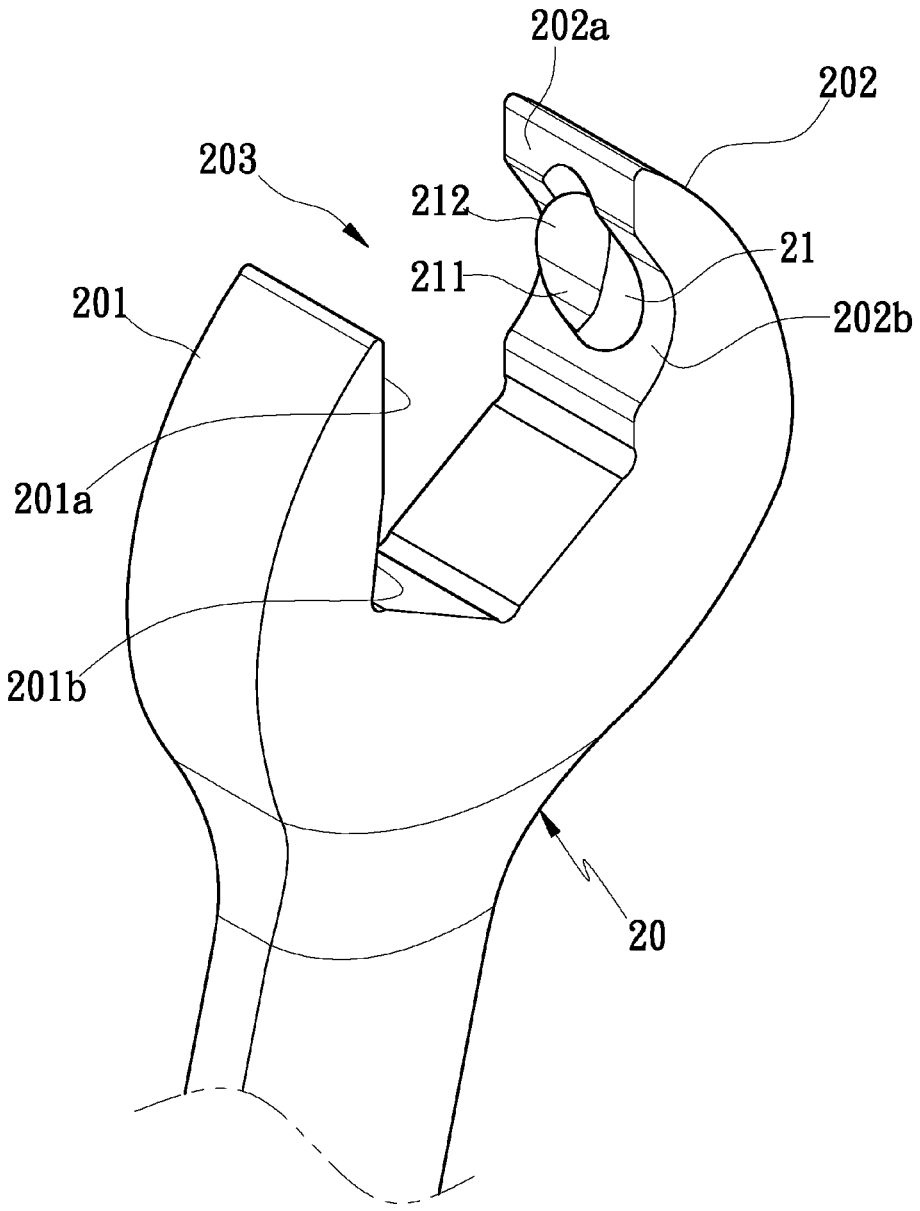
FIG. 5 is a perspective view showing the assembly of the returning device of the wrench tool according to the first embodiment of the present invention.
Figure 6:
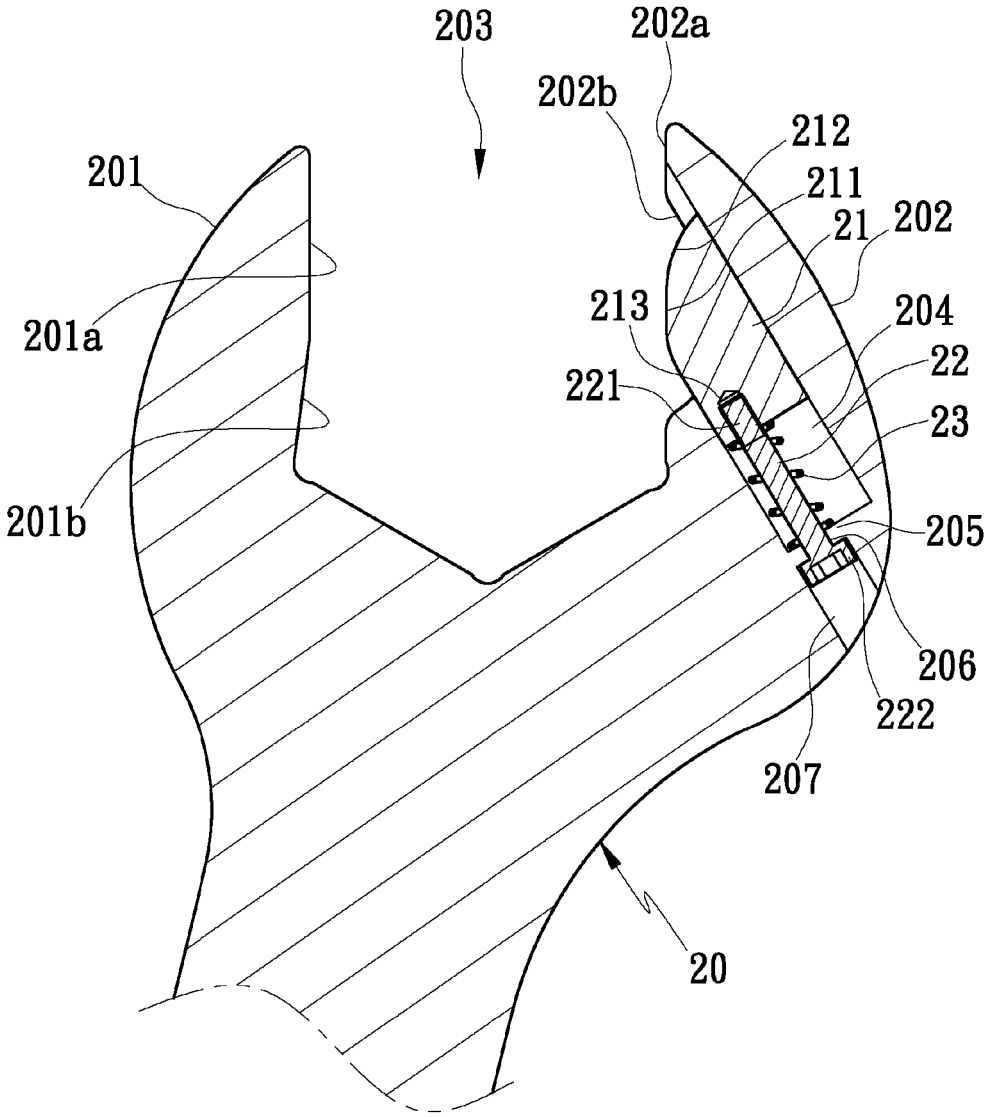
FIG. 6 is a cross sectional view showing the assembly of the returning device of the wrench tool according to the first embodiment of the present invention.

Referring to FIGS. 4-6, a returning device of a wrench tool according to a first embodiment of the present patent comprises a body 20 for an open end wrench, an auxiliary retainer 21, a positioning shaft 22, and a resilient element 23; the body 20 includes a tool segment disposed on at least one end portion thereof, and the tool segment has a first jaw 201 and a second jaw 202, the first jaw 201 includes a first engaging face 201*a* defined on an inner side thereof, and the first engaging face 201*a* includes a first recessed section 201*b* proximate to a stopping edge thereof, and the second jaw 202 includes a second engaging face 202*a* defined on an inner side thereof opposite to the first engaging face 202*a*, between the first engaging face 201*a* of the first jaw 201 and the second engaging face 202*a* of the second jaw 202 is defined a fitting section 203 to fit with a bolt element. The second engaging face 202*a* of the second jaw 202 includes a second recessed section 202*b* in which a receiving groove 204 is formed, and the receiving groove 204 has a stop rim 205, the stop rim 205 includes a slot 206 fixed on an eccentric position thereof and a hole 207 communicating with an outer side of the second jaw 202. In this embodiment, the receiving groove 204 is cylindrical, and between an axial direction of the receiving groove 204 and the second engaging face 202*a* of the second jaw 202 is defined a tilted angle. The receiving groove 204 of the body 20 includes the auxiliary retainer 21 inserted therein, and the auxiliary retainer 21 is formed in a column shape and has a retaining portion 211 defined on a frond end thereof to retain the bolt element and has a pressing portion 212 defined on an end surface to press the bolt element inward and has the positioning shaft 22 connected at an eccentric position of a rear end thereof and extending out of the slot 206 of the body 20 to position the retaining portion 211 of the auxiliary retainer 21.

In this embodiment, the auxiliary retainer 21 includes a screw orifice 213 formed on the eccentric position of the rear end thereof to correspond to the slot 206 of the body 20. The positioning shaft 22 includes a threaded section 221 arranged on a front end thereof to screw with the screw orifice 213 of the auxiliary retainer 21 and its rear end extends into the slot 206 of the body 20, the auxiliary retainer 21 is fixed without rotation by using an eccentric positioning of the auxiliary retainer 21 and the positioning shaft 22. In addition, the resilient element 23 is a spring to push the auxiliary retainer 21 so that the retaining portion 211 of the auxiliary retainer 21 elastically extends out of the second recessed section 202*b* of the second jaw 202, and a limiting element 222 is used to prevent the auxiliary retainer 21 from disengaging from the receiving groove 204 of the body 20. In this embodiment, the resilient element 23 is fitted on the positioning shaft 22 and its one end abuts against the rear end of the auxiliary retainer 21 and its another end is biased against the stop rim 205 of the receiving groove 204, the resilient element 23 pushes the auxiliary retainer 21, and the limiting element 222 is disposed on the rear end of the positioning shaft 22 which extends out of the slot 206 of the body 20 and is limited by the stop rim 205 of the body 20 to prevent the auxiliary retainer 21 from disengagement from the receiving groove 204, and the retaining portion 211 of the auxiliary retainer 21 elastically extends out of the second recessed section 202*b* of the second jaw 202 to retain the bolt element with the first engaging face 201*a* of the first jaw 201, thus removing the bolt element.

Figure 7:
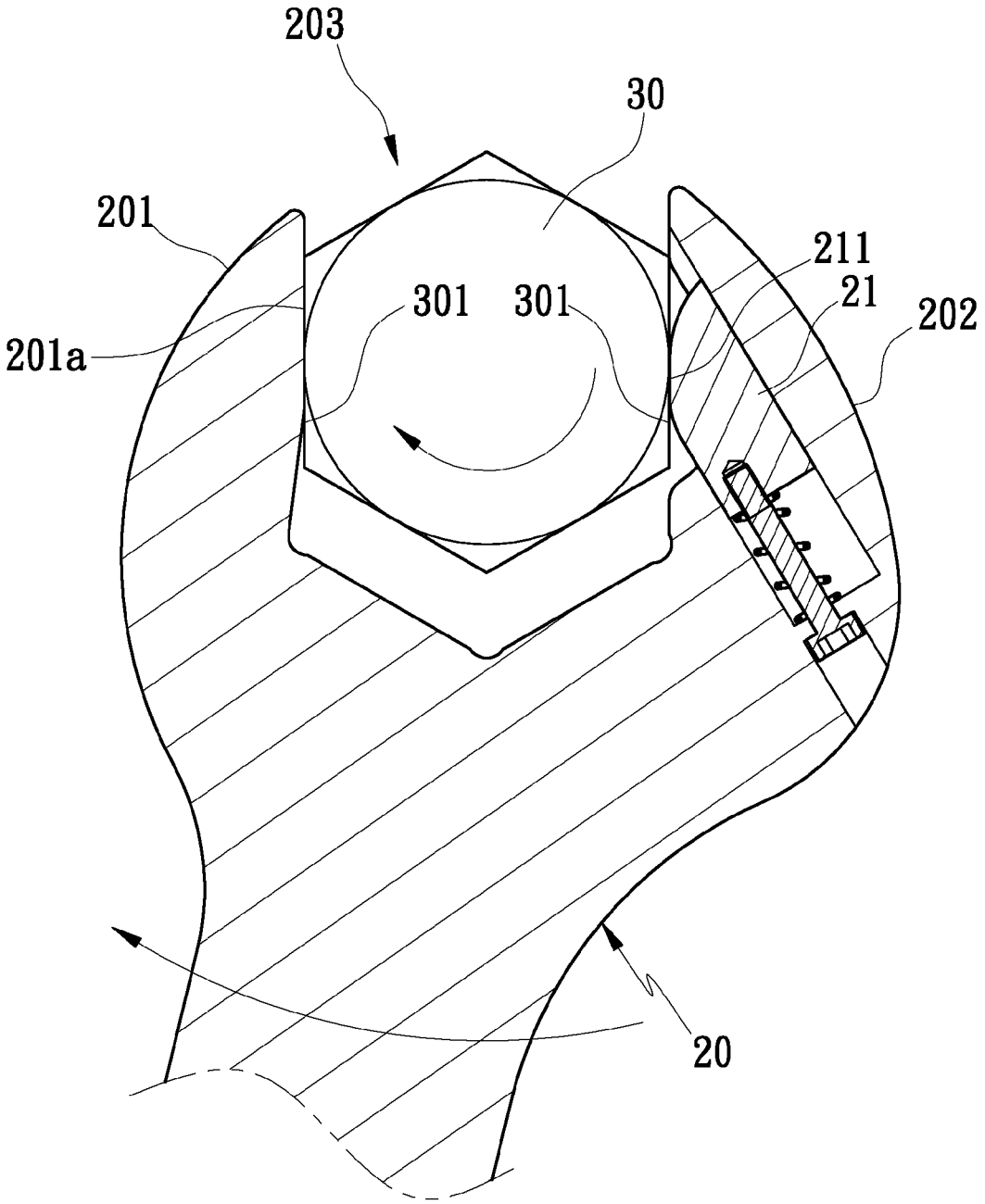
FIG. 7 is a cross sectional view showing the operation of the returning device of the wrench tool according to the first embodiment of the present invention.
Figure 8:
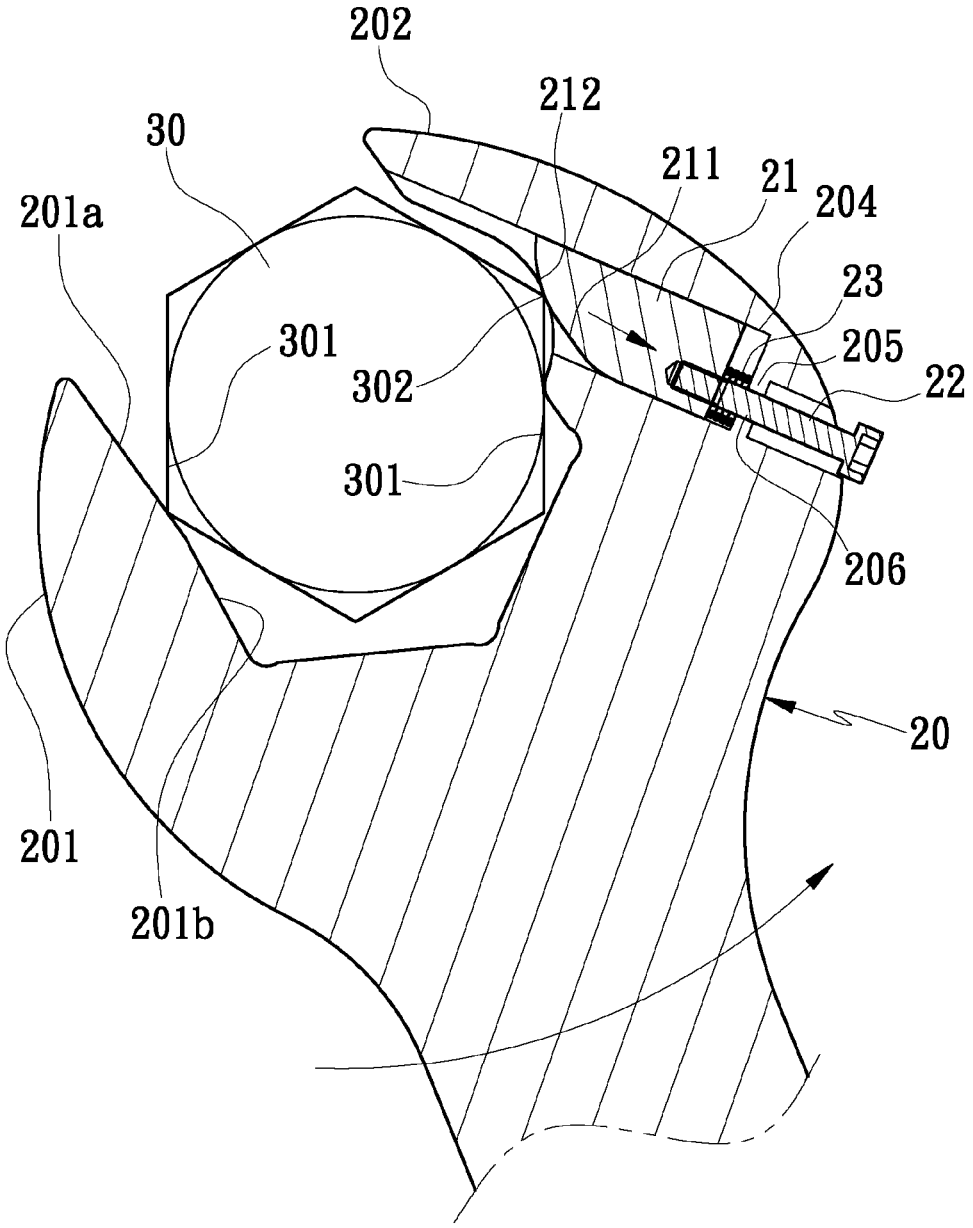
FIG. 8 is another cross sectional view showing the operation of the returning device of the wrench tool according to the first embodiment of the present invention.
Figure 9:
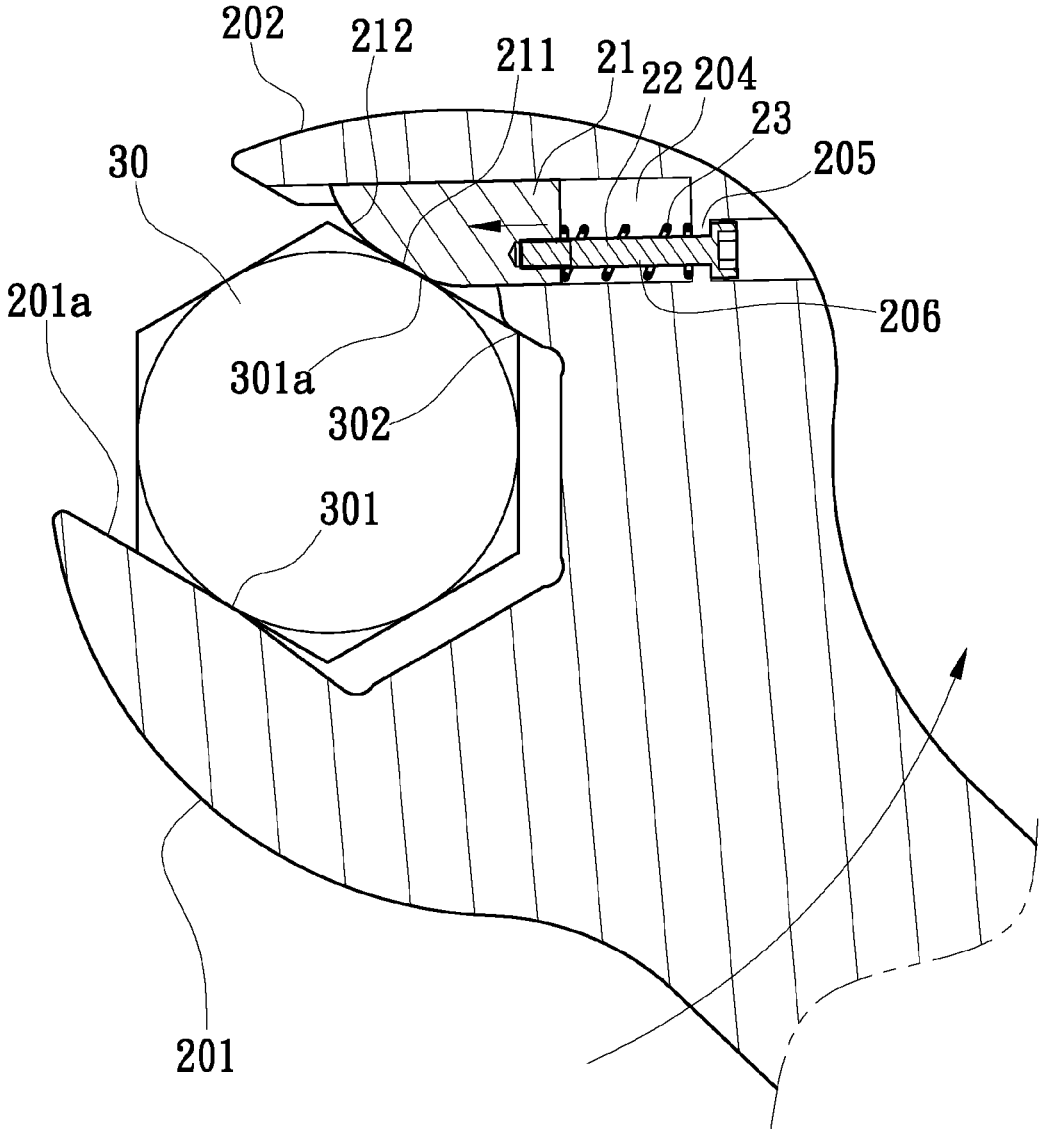
FIG. 9 is also another cross sectional view showing the operation of the returning device of the wrench tool according to the first embodiment of the present invention.

Referring further to FIG. 7, in an disassembly operation, taking a bolt element 30 with a plurality of peripheral sides for example, the fitting section 203 of the body 20 is fitted with the bolt element 30, and two peripheral sides of the bolt element 30 are engaged by the retaining portion 211 of the auxiliary retainer 21 and the first engaging face 201*a* of the first jaw 201 respectively, then the body 20 is rotated in a clockwise direction so that the two peripheral sides of the bolt element 30 further engage the bolt element to rotate, thereby locking the bolt element 30. As shown in FIG. 8, when a rotating space of the body 20 is limited, the body 20 is rotated reversely so that a compensating space is provided by the first recessed section 201*b* of the first jaw 201 and the second recessed section 202*b* of the second jaw 202 so that the body 20 is further rotated reversely, and then the retaining portion 211 of the auxiliary retainer 21 disengages from the two peripheral sides 301 of the bolt element 30 so that an edge corner 302 of the bolt element 30 pushes the pressing portion 212 of the auxiliary retainer 21, and then the auxiliary retainer 21 is moved inward by the pressing portion 212 of the auxiliary retainer 21. As illustrated in FIG. 9, during keeping rotating the body 20 reversely, after the pressing portion 212 of the auxiliary retainer 21 passes across the edge corner 302 of the bolt element 30, the edge corner 302 disengages form the pressing portion 212 of the auxiliary retainer 21, and the resilient element 23 pushes the auxiliary retainer 21 so that the retaining portion 211 of the auxiliary retainer 21 extends toward an original position to retain another two peripheral sides 301*a* with the first engaging face 201*a* of the first jaw 201, such that the body 20 is rotated in the clockwise direction to lock the bolt element 30, and the auxiliary retainer 21 is used to idly rotate the body 20 in a reverse direction.

Figure 10:
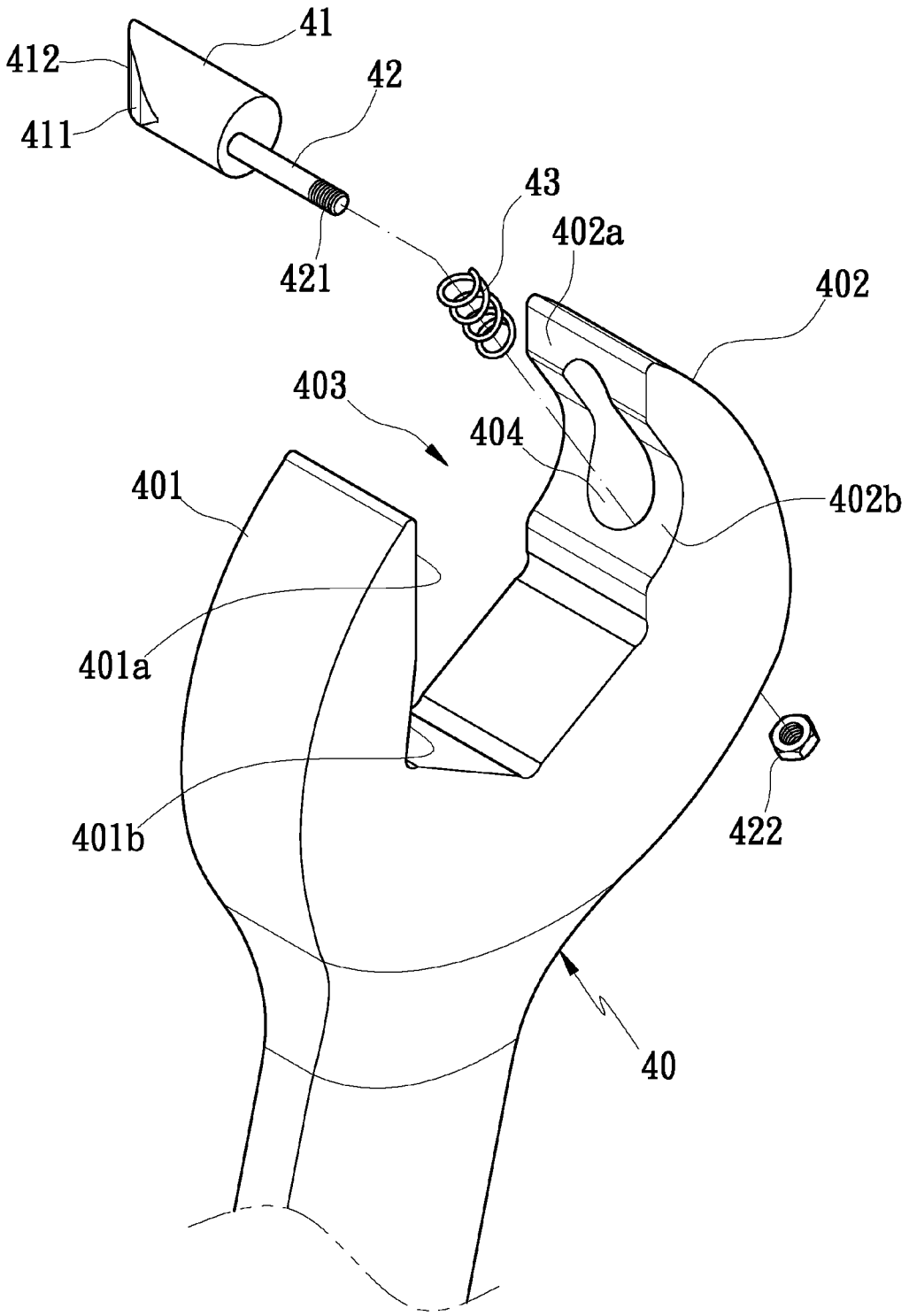
FIG. 10 is a perspective view showing the exploded components of a returning device of a wrench tool according to a second embodiment of the present invention.
Figure 11:
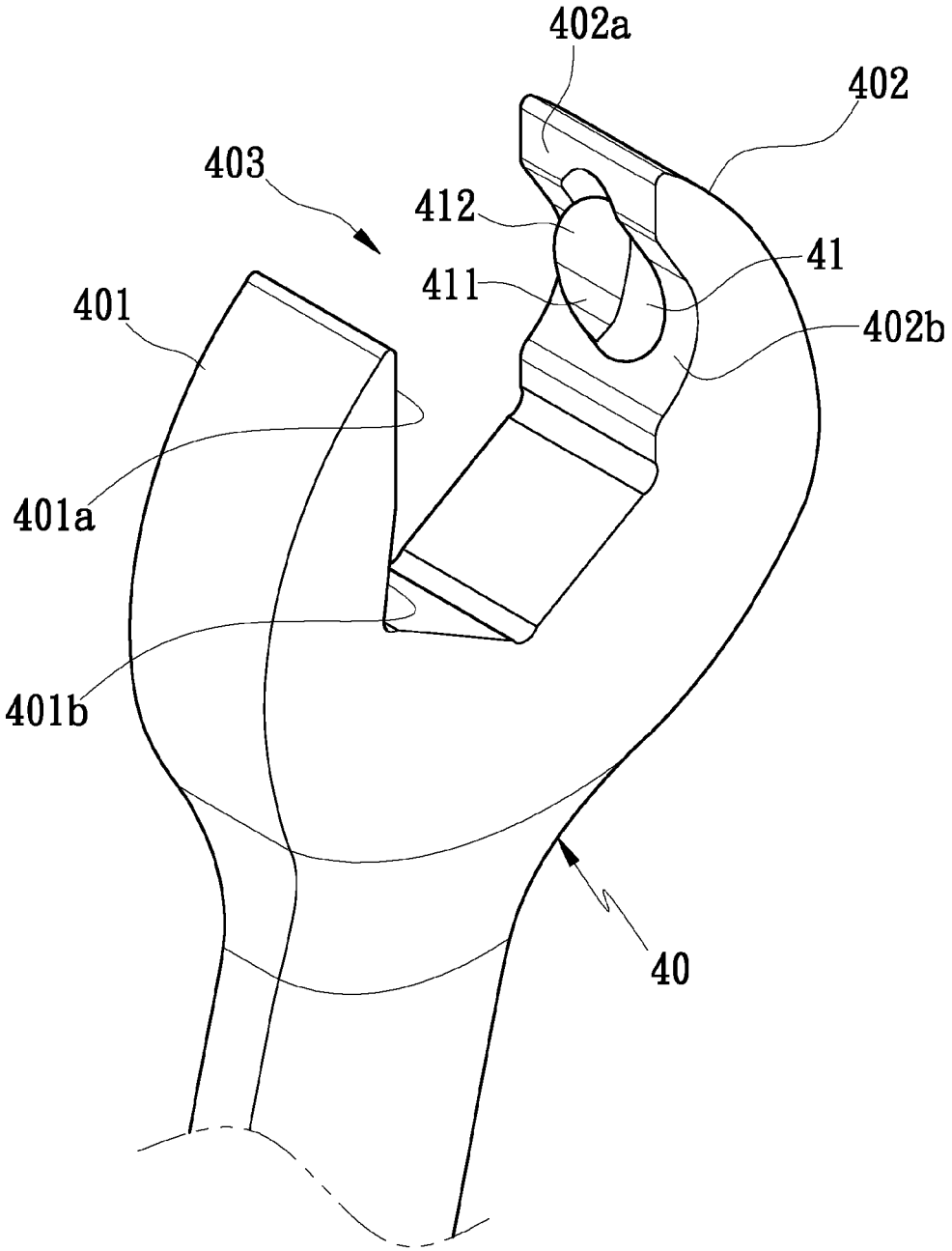
FIG. 11 is a perspective view showing the assembly of the returning device of the wrench tool according to the second embodiment of the present invention.
Figure 12:
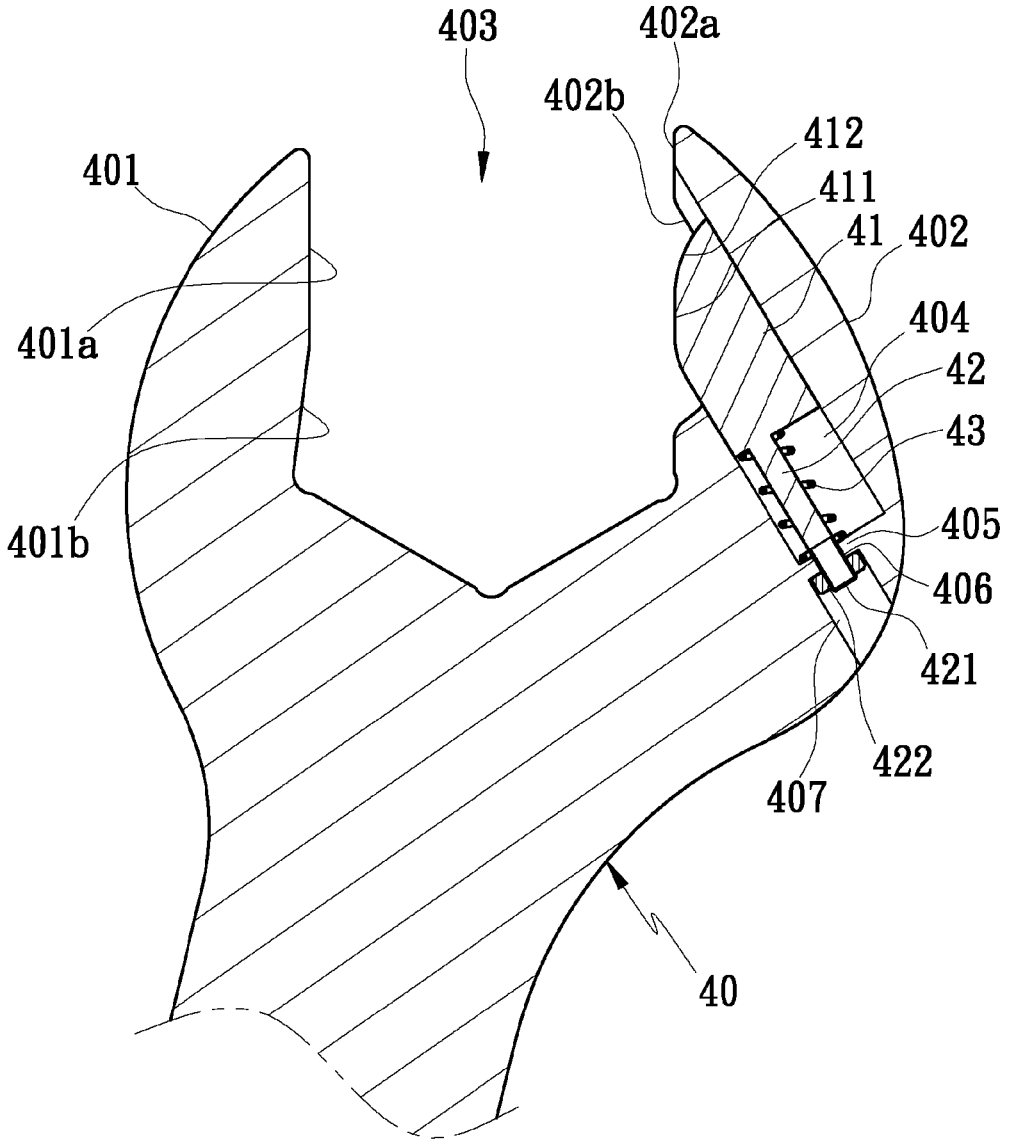
FIG. 12 is a cross sectional view showing the assembly of the returning device of the wrench tool according to the second embodiment of the present invention.

Referring to FIGS. 10-12, a returning device of a wrench tool according to a second embodiment of the present patent comprises a body 40 for an open end wrench, an auxiliary retainer 41, a positioning shaft 42, and a resilient element 43; the body 40 includes a tool segment disposed on at least one end portion thereof, and the tool segment has a first jaw 401 and a second jaw 402, the first jaw 401 includes a first engaging face 401*a* defined on an inner side thereof, and the first engaging face 401*a* includes a first recessed section 401*b* proximate to a stopping edge thereof, and the second jaw 402 includes a second engaging face 402*a* defined on an inner side thereof opposite to the first engaging face 402*a*, between the first engaging face 401*a* of the first jaw 401 and the second engaging face 402*a* of the second jaw 402 is defined a fitting section 403 to fit with a bolt element. The second engaging face 402*a* of the second jaw 402 includes a second recessed section 402*b* in which a receiving groove 404 is formed, and the receiving groove 404 has a stop rim 405, the stop rim 405 includes a slot 406 fixed on an eccentric position thereof and a hole 407 communicating with an outer side of the second jaw 402. In this embodiment, the receiving groove 404 is cylindrical, and between an axial direction of the receiving groove 404 and the second engaging face 402*a* of the second jaw 402 is defined a tilted angle. The receiving groove 404 of the body 40 includes the auxiliary retainer 41 inserted therein, and the auxiliary retainer 41 is formed in a column shape and has a retaining portion 411 defined on a frond end thereof to retain the bolt element and has a pressing portion 412 defined on an end surface to press the bolt element inward and has the positioning shaft 42 connected at an eccentric position of a rear end thereof and extending out of the slot 406 of the body 40 to position the retaining portion 411 of the auxiliary retainer 41. In this embodiment, the auxiliary retainer 41 includes the positioning shaft 42 secured at the eccentric position of the rear end thereof to correspond to an eccentric position of the slot 406 of the body 40 and its rear end extends into the slot 406 of the body 40, the auxiliary retainer 41 is fixed without rotation by using an eccentric positioning of the auxiliary retainer 41 and the positioning shaft 42. In addition, the resilient element 43 is a spring to push the auxiliary retainer 41 so that the retaining portion 411 of the auxiliary retainer 41 elastically extends out of the second recessed section 402*b* of the second jaw 402, and a limiting element 422 is used to prevent the auxiliary retainer 41 from disengaging from the receiving groove 404 of the body 40. In this embodiment, the resilient element 43 is fitted on the positioning shaft 42 and its one end abuts against the rear end of the auxiliary retainer 41 and its another end is biased against the stop rim 405 of the receiving groove 404, the resilient element 43 pushes the auxiliary retainer 41. The positioning shaft 42 includes a threaded section 421 arranged on its rear end which extends out of the slot 406 of the body 40 to screw with the limiting element 422 (i.e., a nut), and the limiting element 422 of the positioning shaft 42 is limited by the stop rim 405 of the body 40 to prevent the auxiliary retainer 41 from disengagement from the receiving groove 404, and the retaining portion 411 of the auxiliary retainer 41 elastically extends out of the second recessed section 402*b* of the second jaw 402 to retain the bolt element with the first engaging face 401*a* of the first jaw 401, thus removing the bolt element. Also, the auxiliary retainer 41 is capable of moving resiliently to provide an idle rotating and returning function in a reverse direction.

Figure 13:
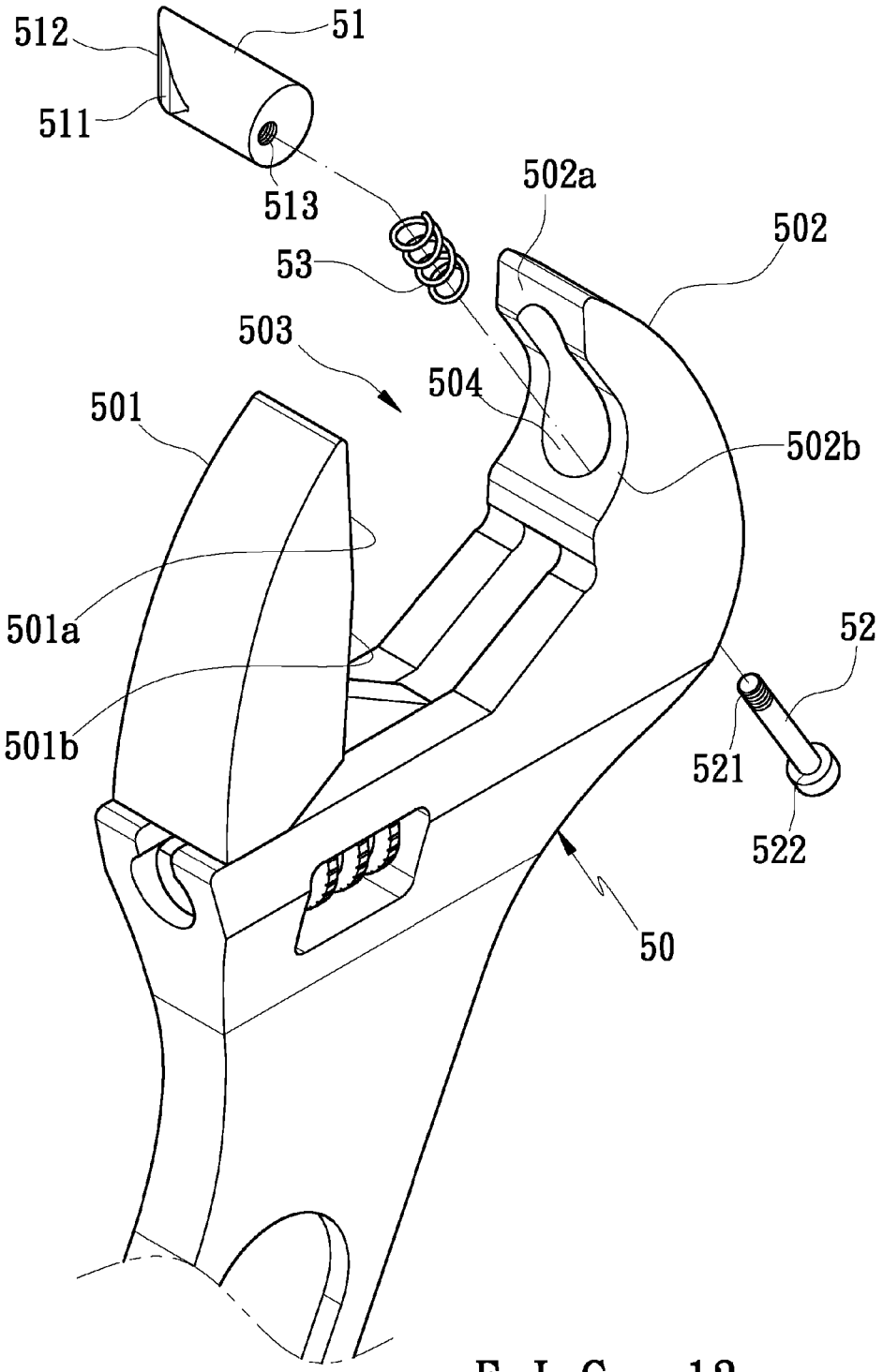
FIG. 13 is a perspective view showing the exploded components of a returning device of a wrench tool according to a third embodiment of the present invention.
Figure 14:
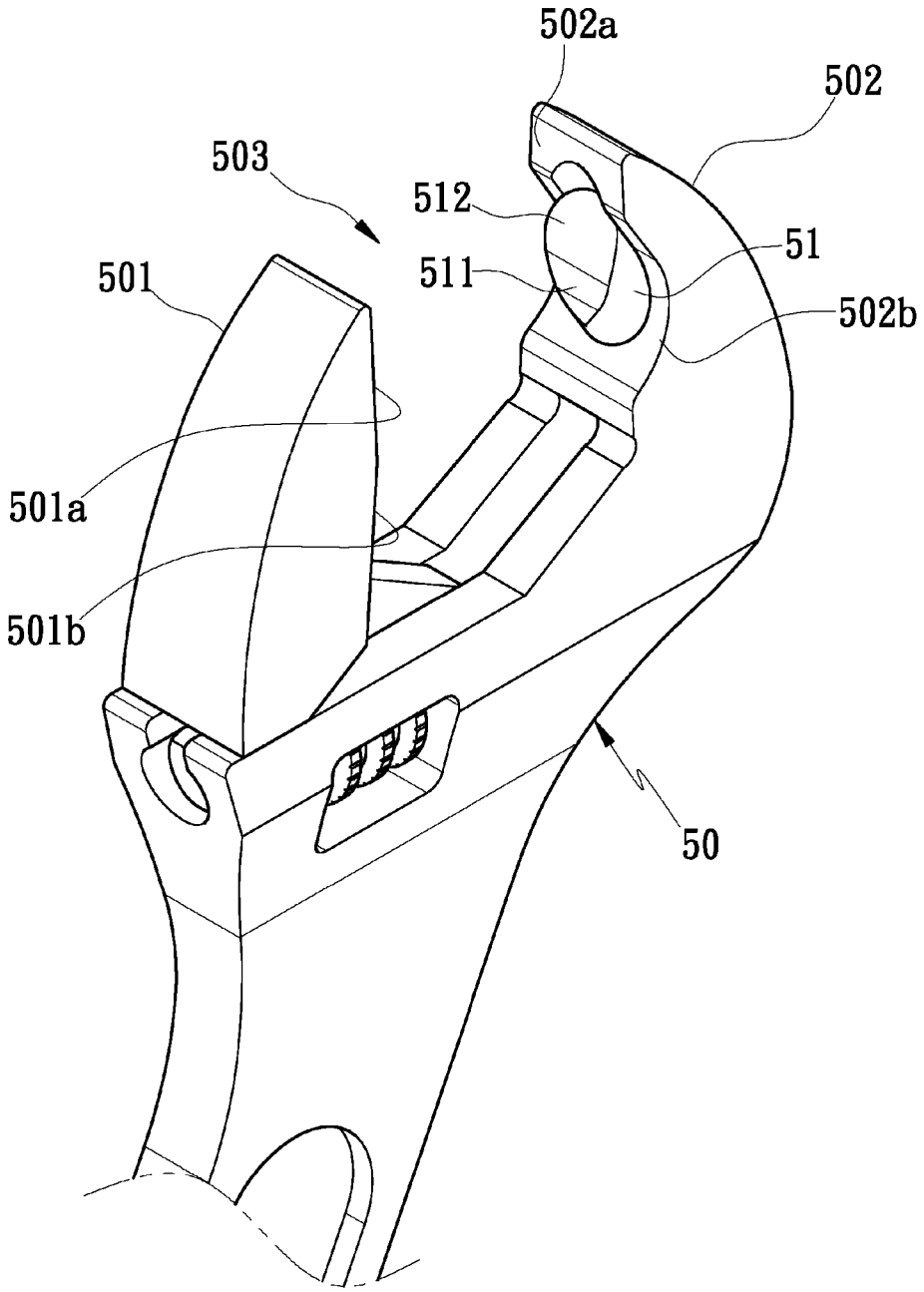
FIG. 14 is a perspective view showing the assembly of the returning device of the wrench tool according to the third embodiment of the present invention.
Figure 15:
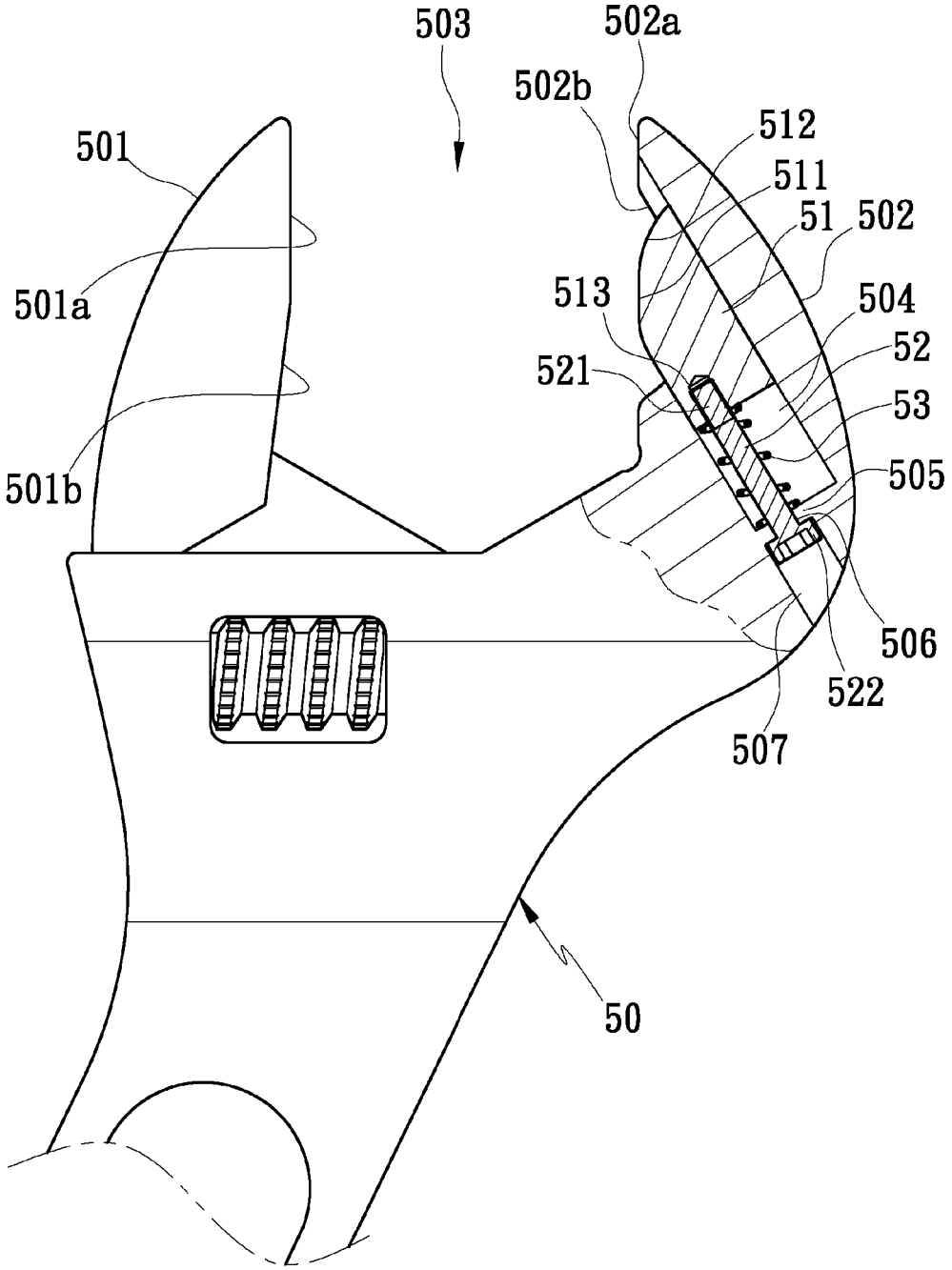
FIG. 15 is a cross sectional view showing the assembly of the returning device of the wrench tool according to the third embodiment of the present invention.

Referring to FIGS. 13-15, a returning device of a wrench tool according to a third embodiment of the present patent comprises a body 50 for an adjustable wrench, an auxiliary retainer 51, a positioning shaft 52, and a resilient element 53; the body 50 includes a tool segment disposed on at least one end portion thereof, and the tool segment has a first jaw 501 and a second jaw 502, the first jaw 501 includes a first engaging face 501*a* defined on an inner side thereof, and the first engaging face 501*a* includes a first recessed section 501*b* proximate to a stopping edge thereof, and the second jaw 502 includes a second engaging face 502*a* defined on an inner side thereof opposite to the first engaging face 502*a*, between the first engaging face 501*a* of the first jaw 501 and the second engaging face 502*a* of the second jaw 502 is defined a fitting section 503 to fit with a bolt element. In this embodiment, the first jaw 502 is adjusted to move, and a distance between the first engaging face 501*a* of the first jaw 501 and the second engaging face 502*a* of the second jaw 502 is changed to fit different sizes of bolt elements. The second engaging face 502*a* of the second jaw 502 includes a second recessed section 502*b* in which a receiving groove 504 is formed, and the receiving groove 504 has a stop rim 505, the stop rim 505 includes a slot 506 fixed on an eccentric position thereof and a hole 507 communicating with an outer side of the second jaw 502. In this embodiment, the receiving groove 504 is cylindrical, and between an axial direction of the receiving groove 504 and the second engaging face 502*a* of the second jaw 502 is defined a tilted angle. The receiving groove 504 of the body 50 includes the auxiliary retainer 51 inserted therein, and the auxiliary retainer 51 is formed in a column shape and has a retaining portion 511 defined on a frond end thereof to retain the bolt element and has a pressing portion 512 defined on an end surface to press the bolt element inward and has the positioning shaft 52 connected at an eccentric position of a rear end thereof and extending out of the slot 506 of the body 50 to position the retaining portion 511 of the auxiliary retainer 51. In this embodiment, the auxiliary retainer 51 includes a screw orifice 513 formed on the eccentric position of the rear end thereof to correspond to the slot 506 of the body 50. The positioning shaft 52 includes a threaded section 521 arranged on a front end thereof to screw with the screw orifice 513 of the auxiliary retainer 51 and its rear end extends into the slot 506 of the body 50, the auxiliary retainer 51 is fixed without rotation by using an eccentric positioning of the auxiliary retainer 51 and the positioning shaft 52. In addition, the resilient element 53 is a spring to push the auxiliary retainer 51 so that the retaining portion 511 of the auxiliary retainer 51 elastically extends out of the second recessed section 502*b* of the second jaw 502, and a limiting element 522 is used to prevent the auxiliary retainer 51 from disengaging from the receiving groove 504 of the body 50. In this embodiment, the resilient element 53 is fitted on the positioning shaft 52 and its one end abuts against the rear end of the auxiliary retainer 51 and its another end is biased against the stop rim 505 of the receiving groove 504, the resilient element 53 pushes the auxiliary retainer 51, and the limiting element 522 is disposed on the rear end of the positioning shaft 52 which extends out of the slot 506 of the body 50 and is limited by the stop rim 505 of the body 50 to prevent the auxiliary retainer 51 from disengagement from the receiving groove 504, and the retaining portion 511 of the auxiliary retainer 51 elastically extends out of the second recessed section 502*b* of the second jaw 502 to retain the bolt element with the first engaging face 501*a* of the first jaw 501, thus removing the bolt element. Also, the auxiliary retainer 51 is capable of moving resiliently to provide an idle rotating and returning function in a reverse direction.

While we have shown and described various embodiments in accordance with the present invention, it is clear to those skilled in the art that further embodiments may be made without departing from the scope of the present invention.

What is claimed is:

1. A returning device of a wrench tool comprising:

a body including a tool segment disposed on at least one end portion thereof, and the tool segment having two jaws, an engaging face of at least one of the two jaws including a recessed section in which a receiving groove is formed in a cylinder shape, and the receiving groove having a stop rim, the stop rim of the receiving groove including a slot defined on an eccentric position thereof;

an auxiliary retainer inserted in the receiving groove of the body and having a retaining portion defined on a frond end thereof, the auxiliary retainer being formed in a circular column shape;

a positioning shaft including a front end connected at an eccentric position of a rear end of the auxiliary retainer and including a rear end extending out of the slot of the body and allowing to prevent the auxiliary retainer from disengagement from the receiving groove of the body;

a resilient element used to push the auxiliary retainer so that the retaining portion of the auxiliary retainer elastically extends out of the recessed section of the at least one of the two jaws of the body;

wherein a central axis of the receiving groove is parallel to a central axis of the slot of the stop rim of the receiving groove, and the slot is defined on the eccentric position of the stop rim of the receiving groove, such that the auxiliary retainer, formed in the circular column shape, slides and does not rotate in the receiving groove.

2. The returning device of the wrench tool as claimed in claim 1, wherein the body includes the tool segment disposed on the at least one end portion thereof and having a first jaw and a second jaw, the first jaw includes a first engaging face defined on an inner side thereof, and the second jaw includes a second engaging face defined on an inner side thereof opposite to the first engaging face, between the first engaging face of the first jaw and the second engaging face of the second jaw is defined a fitting section to fit with a bolt element.

3. The returning device of the wrench tool as claimed in claim 2, wherein the first engaging face of the first jaw includes a first recessed section, and the second engaging face of the second jaw includes a second recessed section.

4. The returning device of the wrench tool as claimed in claim 1, wherein between an axial direction of the receiving groove of the body and the second engaging face of the second jaw is defined a tilted angle.

5. The returning device of the wrench tool as claimed in claim 1, wherein the auxiliary retainer has a pressing portion defined on an end surface to press the bolt element inward.

6. The returning device of the wrench tool as claimed in claim 1, wherein the auxiliary retainer includes a screw orifice formed on the eccentric position of the rear end thereof to correspond to the slot of the body, the positioning shaft includes a threaded section arranged on a front end thereof to screw with the screw orifice of the auxiliary retainer, and the rear end of the positioning shaft extends into the slot of the body.

7. The returning device of the wrench tool as claimed in claim 1, wherein the limiting element is disposed on the rear end of the positioning shaft which extends out of the slot of the body and is limited by the stop rim of the body.

8. The returning device of the wrench tool as claimed in claim 1, wherein the positioning shaft includes a threaded section arranged on its rear end which extends out of the slot of the body to screw with the limiting element, and the limiting element is a nut and is limited by the stop rim of the body.

9. The returning device of the wrench tool as claimed in claim 1, wherein the resilient element is fitted on the positioning shaft and one end thereof abuts against the rear end of the auxiliary retainer and another end thereof is biased against the stop rim of the receiving groove so that the resilient element pushes the auxiliary retainer, and the retaining portion of the auxiliary retainer elastically extends out of the recessed section of the at least one of the two jaws.

10. The returning device of the wrench tool as claimed in claim 1, wherein the resilient element is a spring.

* * * * *